United States Patent [19]

Nitta

[11] Patent Number: 4,884,965

[45] Date of Patent: Dec. 5, 1989

[54] GASLIGHTER STRUCTURE PERMITTING PUSH-FIT ASSEMBLING OF ITS MAIN PARTS

[75] Inventor: Tomio Nitta, Yokohama, Japan

[73] Assignee: Tokai Corporation, Yokohama, Japan

[21] Appl. No.: 285,457

[22] Filed: Dec. 16, 1988

[30] Foreign Application Priority Data

Dec. 28, 1987 [JP] Japan ..... 62-197397[U]

[51] Int. Cl.[4] ..... F23Q 1/02

[52] U.S. Cl. ..... 431/277; 431/267; 431/273; 431/152

[58] Field of Search ..... 431/267, 273, 274, 276, 431/277, 135, 129, 146, 152

[56] References Cited

U.S. PATENT DOCUMENTS 4,102,633 7/1978 Zellweger et al. ..... 431/277 X

FOREIGN PATENT DOCUMENTS 2715961 10/1977 Fed. Rep. of Germany ..... 431/277

1441565 7/1976 United Kingdom ..... 431/277

*Primary Examiner*—Randall L. Green

*Attorney, Agent, or Firm*—Armstrong, Nikaido, Marmelstein, Kubovcik & Murray

[57] ABSTRACT

Disclosed is a gaslighter structure comprising a lighter housing equipped with female pivot means provided to the rear, upper side of the housing; a fire-striking unit having push-fit means to integrally combine the unit with the housing, and a cap having male pivot means to fit in the female pivot means of the housing. This arrangement permits the push-fit assembling of the fire-striking unit to the housing and the cap to the housing, thereby simplifying the assembling work and accordingly contributing the automatization of the assembling process.

2 Claims, 3 Drawing Sheets

GASLIGHTER STRUCTURE PERMITTING PUSH-FIT ASSEMBLING OF ITS MAIN PARTS

BACKGROUND OF THE INVENTION

1. Field of the Invention

The present invention relates to a gaslighter.

2. Related Art

As is well known, a gaslighter has many small parts assembled. These lighter parts are assembled by hand. In the field of gas lighter industry the tendency is towards the reduction of the size and weight of lighter parts. Thus, assembling work increasingly requires skillfulness and much time invloved, and as a matter of fact the efficiency with which such small parts are assembled, cannot be improved.

SUMMARY OF THE INVENTION

With the above in mind one object of the present invention is to provide a gaslighter structure which permits the reduction of the number of the assembling steps, accordingly increasing the assembling efficiency.

To attain this object a gaslighter according to the present invention comprises: a lighter housing constituting a gas well and having a gas ejection nozzle fixed to the top of the housing and pivot means provided to the rear, upper side of the housing; a fire-striking unit including a holder covered with an inner cap which has a flame opening at its front end, said holder having push-fit means to integrally combine the holder with the housing, a fire-striking assembly fixed to the holder in vicinity of the flame opening, and a pipe laid on the underside of the holder with its head top close to the flame opening and its tail tip connected to the gas election nozzle; and a cap having counter pivot means to the pivot means of the housing, thereby permitting the cap to rotate about its pivot for closing and disclosing the fire-striking unit on the top of the housing. This arrangement permits the push-fit of the fire-striking unit and the cap to the lighter housing.

Other objects and advantages of the present invention will be understood from the following description of a gaslighter according to one preferred embodiment of the present invention, which is shown in the accompanying drawings:

PREFERRED EMBODIMENT OF THE INVENTION

Figure 1:
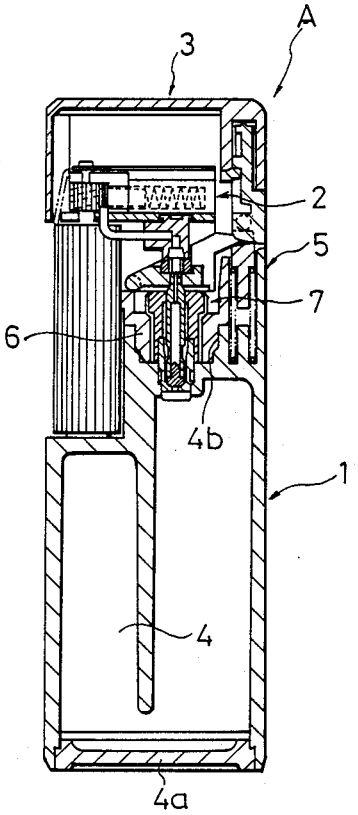
FIG. 1 is a longitudinal section of a gaslighter according to one preferred embodiment of the present invention.
Figure 2:
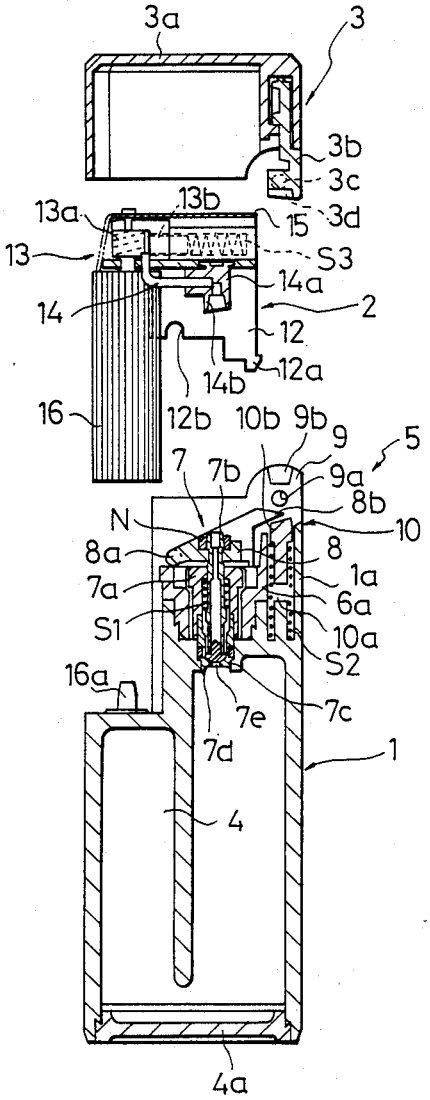
FIG. 2 is a longitudinal section of the gas lighter exploded into main parts.
Figure 3:
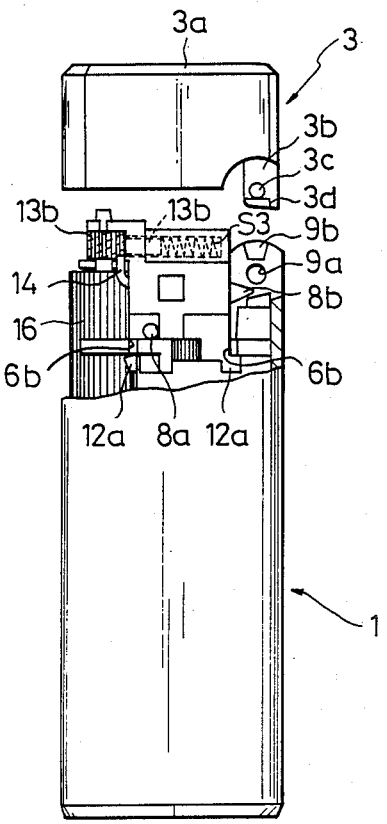
FIGS. 3 and 4 are side views of the gaslighter partly broken and separated into main parts.
Figure 4:
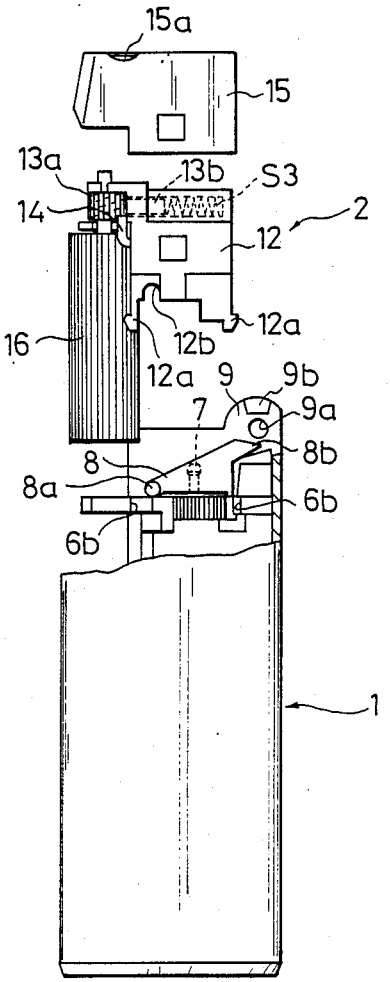

Referring to the drawings, a gaslighter A according to one embodiment of the present invention is shown as comprising a lighter housing 1, a fire-striking unit 2 and a cap 3. The lighter housing 1 is made of a synthetic resin, constituting a gas well 4. The lighter housing 1 has pivot means 5 provided to the rear, upper side of the housing for permitting the opening and closing of the cap 3. The lighter housing 1 has a bottom closure 4*a* fitted in its bottom opening and a top plug 6 fitted in the recess of the top of the lighter housing 1 in alignment with the opening 4*b* of the top of the lighter housing 1. A gas ejection nozzle 7 is fixed to the top plug 6 to be put in communication with the inside of the gas well 4. The gas ejection nozzle 7 comprises an outer hollow cylinder 7*a*, a gas ejection pipe 7*b* movably inserted in the outer hollow cylinder 7*a* with its tip appearing above the upper surface of the outer hollow cylinder 7*a*, and an inner hollow cylinder 7*c* which is inserted in the somewhat enlarged bottom opening of the outer hollow cylinder 7*a*. The inner hollow cylinder 7*c* opens at its bottom to communicate with the inside of the gas well 4. As shown, the gas ejection pipe 7*b* is biased downward by a spring S1 all the time, thereby closing the bottom hole 7*e* of the inner hollow cylinder 7*c* with its rubber plug 7*d*.

A lever 8 is fixed at its center to the tip of the gas ejection pipe 7*b* via a rubber ring N. The lever 8 has two pivots 8*a* projecting from the opposite sides of the front end of the lever, and two catch extensions 8*b* projecting backward from the opposite sides of the rear end of the lever.

The cap pivot means 5 comprises opposite extensions 9 in the rear, upper opposite sides of the lighter housing 1 and a lock unit 10 just below the extensions 9. The rear support 3*b* of the cap 3 can be rotatably fitted in the opposite extensions as later described.

Figure 5:
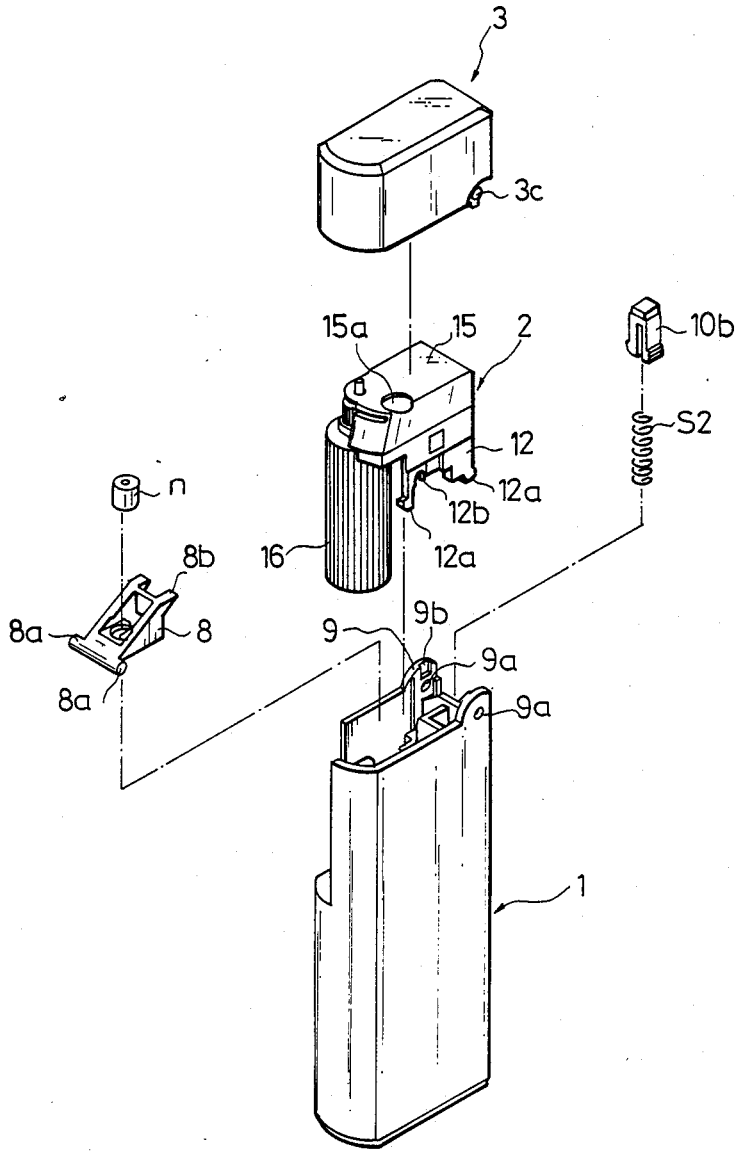
FIG. 5 is a perspective exploded view of the gaslighter.

Pivot holes 9*a* are made in the rear, upper opposite extensions 9*a* of the lighter housing 1, which the extensions are resilient. At best seen in FIG. 5, a guide slot 9*b* is made on each extension 9 to guide each pivot 3*c* to the pivot hole 9*a* to ensure the smooth push-fit of the cap pivots 3*c* in the pivot holes 9*a* of the lighter housing. The lockunit 10 is composed by a push piece 10*b*, which is inserted in the groove 10*a* between the rear wall 6*a* of the top plug 6 and the rear side 1*a* of the lighter housing 1. The push piece 10*b* can move vertically in the groove 10*a* under the influence of a spring S2.

A fire-striking unit 2 includes a holder 12, a fire-striking assembly 13 and a pipe 14. The holder 12 is made of a synthetic resin in the form of inverted "U". The holder 12 has three hooks 12*a* integrally connected to its lower edge. The holder 12 can be fixed to the lighter housing 1 with its hooks 12*a* caught by corresponding catch slots 6*b* made in the top plug 6.

The holder 12 has reentrances 12*b* at its lower front. When the holder 12 is push-fitted in the top of the housing 1, the opposite pivot projections 8*a* of the lever 8 are put in the reentrances 12*b*. Then, the lever 8 can rotae about its pivot 8*a* to raise the gas ejection pipe 7*b* for ejecting the gas from the gas well 4. The holder 12 has a metal cover 15 put thereon. The metal cover 15 has a flame opening 15*a* at its left front corner. The front tip of the pipe 14 is put close to the flame opening 15*a*, and the rear tip of the pipe 14 is inserted into one opening end of the "L"-shaped channel 14*b* of a connector block 14*a* which is fixed to the lower surface of the holder 12. When the holder 12 is push-fitted to the top of the housing 1, the tip of the gas ejection nozzle pipe 7*b* is inserted in the other opening end of the "L"-shaped channel 14*b* of the connector block 14*a*.

The fire-striking assembly comprises a file wheel 13*a* and a flint 13*b* which is pushed against the file wheel 13*a* by a spring S3. The file wheel 13*a* is rotatably fixed to the front of the holder 12 in the vicinity of the flame opening 15*a*. A rotary cylinder 16 is integrally connected to the file wheel 13*a*. When the rotary cylinder 16 is rotated, the file wheel 13*a* is rotated to rub the flint 13*b* for ignition of the gas which is ejected from the tip of the pipe 14.

In assembling, the fire-striking-unit 2 is push-fitted in the top of the housing 1. Then, the hooks 12*a* of the holder 12 are caught by the catch slots 6*b* of the top plug 6. At the same time the rotary cylinder 16 stands on the shoulder of the housing 1 with the pivot projection 16*a* on the shoulder fitted in the counter hole of the rotary cylinder bottom.

The cap 3 is composed of a metal enclosure 3*a* and a support piece 3*b* integrally connected to the rear side of the metal enclosure 3*a*. The support piece 3*b* has opposite pivot projections 3*c* on the lower opposite surfaces of the support piece 3*b*. When the cap 3 and the housing 1 are assembled together, the support piece 3*b* of the cap 3 is push-fitted in the housing 1. Specifically, the opposite pivot projections 3*c* of the support piece 3*b* are fitted in the pivot holes 9*a* of the housing 1, and the bottom end of the support piece 3*b* rides on the top end of the push piece 10*b* of the lock unit 10. Then, the cap 3 can be rotated about its pivot 3*c* to its opening or closing position. The support piece 3*b* has a recess 3*d* on its bottom end, and the free end 8*b* of the lever 8 is inserted in the recess 3*d* of the support piece 3*b*. Thus, the opening of the cap 3 will cause the inclination of the lever 8 about its pivot 8*a* to raise the gas ejection pipe 7*b*, thereby opening the gas nozzle.

When the cap 3 is push-fitted in the housing 1, the opposite pivot projections 3*c* of the support piece 3*b* are somewhat forcedly inserted in the space between the rear opposite extension S9 of the housing 1 by causing them to yieldingly bend to somewhat expand the inter space. The opposite pivot projections 3*c* are guided by the guide slots 9*b* on the inside surfaces of the rear opposite extensions 9 of the housing 1 until they fall in the pivot holes 9*a* of the housing 1. Then, the rear opposite extenstions 9 of the housing 1 snap back to the original stress-free position to pivot the cap 3 to the housing 1.

As may be understood from the above, a gas lighter structure according to the present invention permits the push-fit assembling of the fire-striking unit to the housing and the cap to the housing, thereby simplifying the assembling work and accordingly contributing the automatization of the assembling process.

What is claimed is:

1. A gaslighter comprising:

a lighter housing constituting a gas well and having a gas ejection nozzle fixed to the top of the housing and pivot means provided to the rear, upper side of the housing;

a fire-striking unit including a holder covered with an inner cap which has a flame opening at its front end, said holder having push-fit means to integrally combine the holder with the housing, a fire-striking assembly fixed to the holder in the vicinity of the flame opening, and a pipe laid on the underside of the holder with its head tip close connected to the flame opening and its tail tip connected to the gas ejection nozzle; and a cap having counter pivot means to the pivot means of the housing, thereby permitting the cap to rotate about its pivot for closing and disclosing the fire-striking unit on the top of the housing.

2. A gas lighter claiming in claim 1 wherein said push-fit means comprises catch projections integrally connected to the bottom part of the holder and catch recesses made in the top of the housing, and said pivot means of the housing comprises female recesses or holes made on the opposite sides of the rear, upper extensions of the housing whereas said counter pivot means of said cap comprises male projections provided on opposite sides of the rear, lower corners of the cap.

* * * * *